US008202037B2

(12) United States Patent
Deidewig et al.

(10) Patent No.: US 8,202,037 B2
(45) Date of Patent: Jun. 19, 2012

(54) STEAM TURBINE AND METHOD FOR OPERATION OF A STEAM TURBINE

(75) Inventors: Frank Deidewig, Essen (DE); Yevgen Kostenko, Ratingen (DE); Oliver Myschi, Duisburg (DE); Michael Wechsung, Mülheim an der Ruhr (DE); Uwe Zander, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1056 days.

(21) Appl. No.: 11/659,405

(22) PCT Filed: Jul. 14, 2005

(86) PCT No.: PCT/EP2005/053375

§ 371 (c)(1), (2), (4) Date: Feb. 15, 2008

(87) PCT Pub. No.: WO2006/015923

PCT Pub. Date: Feb. 16, 2006

(65) Prior Publication Data

US 2008/0213085 A1 Sep. 4, 2008

(30) Foreign Application Priority Data

Aug. 2, 2004 (EP) ..... 04018285

(51) Int. Cl.
*F01D 3/04* (2006.01)

(52) U.S. Cl. ..... 415/1; 415/100; 415/104; 415/106; 415/107; 415/108; 415/58.7; 415/59.1

(58) Field of Classification Search ..... 415/100, 415/104, 105, 106, 107, 140, 58.7, 59.1, 415/144, 23, 108, 93, 1
See application file for complete search history.

(56) References Cited

U.S. PATENT DOCUMENTS 902,252 A 10/1908 Roth (Continued)

FOREIGN PATENT DOCUMENTS

DE 519 060 2/1931

(Continued)

OTHER PUBLICATIONS

H.G. Neft, G. Franconville, "Neue Dampfturbinenkonzepte für höhere Eintrittsparameter und längere Endschaufeln", VGB Kraftwerkstechnik vol. 73, 1993, No. 5, pp. 409-415, Abstract.

*Primary Examiner* — Christopher Verdier

(57) ABSTRACT

Disclosed is a steam turbine comprising an exterior housing and an interior housing. The exterior housing and the interior housing are provided with a fresh steam supply duct. A rotor that encompasses several impeller blades and a thrust-compensating piston is rotably mounted within the interior housing. The interior housing is equipped with several guide blades that are disposed such that a flow duct comprising several blade stages, each of which comprises a series of impeller blades and a series of guide blades, is formed along a specific direction of flow. The interior housing is further equipped with a recirculation duct which is embodied as a pipe that communicates between a space located between the interior housing and the exterior housing and the flow duct downstream of a blade stage. The interior housing is additionally equipped with a supply duct that is configured as a pipe which communicates between the space located between the interior housing and the exterior housing and an antechamber of the thrust-compensating piston located between the thrust-compensating piston of the rotor and of the interior housing.

16 Claims, 2 Drawing Sheets

U.S. PATENT DOCUMENTS

| | | | | | |
|---|---|---|---|---|---|
| 968,839 | A | * | 8/1910 | Ehrhart | 415/107 |
| 1,347,591 | A | | 7/1920 | Röder | |
| 2,300,758 | A | * | 11/1942 | Zetterquist | 415/107 |
| 2,304,994 | A | * | 12/1942 | Franck | 415/107 |
| 2,796,231 | A | * | 6/1957 | Hertl | 415/108 |
| 2,920,867 | A | * | 1/1960 | Reese et al. | 415/96 |
| 3,614,255 | A | * | 10/1971 | Rooney | 415/100 |
| 4,661,043 | A | | 4/1987 | Groenendaal, Jr. et al. | |
| 6,102,654 | A | | 8/2000 | Oeynhausen et al. | |
| 7,331,757 | B2 | * | 2/2008 | Janssen et al. | 415/200 |

FOREIGN PATENT DOCUMENTS

| | | | |
|---|---|---|---|
| DE | 520 226 | | 2/1931 |
| DE | 34 21 067 | A1 | 12/1984 |
| DE | 1774140 | B1 | 4/2007 |
| EP | 1 154 123 | A1 | 11/2001 |
| JP | 62101801 | A | 5/1987 |
| JP | 63167001 | A | 7/1988 |
| JP | 11303647 | A | 11/1999 |
| WO | WO 97/49900 | A1 | 12/1997 |
| WO | WO 97/49901 | | 12/1997 |

* cited by examiner

STEAM TURBINE AND METHOD FOR OPERATION OF A STEAM TURBINE

CROSS REFERENCE TO RELATED APPLICATIONS

This application is the US National Stage of International Application No. PCT/EP2005/053375, filed Jul. 14, 2005 and claims the benefit thereof. The International Application claims the benefits of European application No. 04018285.9 filed Aug. 2, 2004, both of the applications are incorporated by reference herein in their entirety.

FIELD OF INVENTION

The invention relates to a steam turbine with an outer casing and an inner casing, wherein the outer casing and the inner casing have a live steam feed duct, wherein a rotor, which has a thrust balance piston and which comprises a plurality of rotor blades, is installed in a rotatably mounted manner inside the inner casing, and the inner casing has a plurality of stator blades which are arranged in such a way that a flow passage, with a plurality of blade stages which in each case has a row of rotor blades and a row of stator blades, is formed along a flow direction.

Furthermore, the invention relates to a method for the production of a steam turbine with an outer casing and an inner casing, wherein the outer casing and the inner casing have a live steam feed duct, wherein a rotor, which has a thrust balance piston and which comprises a plurality of rotor blades, is installed in a rotatably mounted manner inside the inner casing, and a plurality of stator blades is arranged on the inner casing in such a way that a flow passage, with a plurality of blade stages which in each case have a row of rotor blades and a row of stator blades, is formed along a flow direction, through which flow passages steam flows during operation.

BACKGROUND OF THE INVENTION

Each turbine, or turbine section, is understood to be a steam turbine within the meaning of the present application, which is exposed to throughflow by a working medium in the form of steam. In contrast to this, gas turbines are exposed to throughflow by gas and/or air as working medium which, however, is subjected to completely different temperature and pressure conditions than the steam in a steam turbine. As opposed to gas turbines, in steam turbines, for example the working medium which flows in a turbine section at the highest temperature, simultaneously has the highest pressure. An open cooling system, which is open to the flow passage, is realizable in gas turbines even without external feed for cooling medium to turbine sections. For a steam turbine, an external feed of cooling medium should be provided. The prior art with regard to gas turbines cannot be drawn upon for the assessment of the subject matter of the present application, if only for that reason.

A steam turbine customarily comprises a rotatably mounted rotor which is populated with blades, which is installed inside a casing or casing shell, as the case may be. During throughflow exposure of the interior space of the flow passage, which is formed by the casing shell, to heated and pressurized steam, the rotor, via the blades, is set in rotation by means of the steam. The blades of the rotor are also referred to as rotor blades. Furthermore, stationary stator blades are customarily suspended on the inner casing, which stator blades reach into the interspaces of the rotor blades along an axial extent of the body. A stator blade is customarily mounted at a first point along an inner side of the steam turbine casing. In this case, it is customarily part of a stator blade row which comprises a number of stator blades which are arranged along an inside circumference on the inner side of the steam turbine casing. In this case, each stator blade points radially inwards with its blade airfoil. A stator blade row at the first point which was mentioned along the axial extent is also referred to as a stator blade cascade or stator blade ring. A number of stator blade rows is customarily connected one after the other. At a second point along the axial extent, behind the first point, a second further blade is correspondingly mounted along the inner side of the steam turbine casing. A pair of one stator blade row and one rotor blade row is also referred to as a blade stage.

The casing shell of such a steam turbine can be formed from a number of casing segments. Especially the stationary casing component of a steam turbine, or turbine section, is understood to be the casing shell of the steam turbine, which along the longitudinal direction of the steam turbine has an interior space in the form of a flow passage which is provided for throughflow exposure to the working medium in the form of steam. Depending upon the type of steam turbine, this can be an inner casing and/or a stator blade carrier. However, a turbine casing can also be provided which has no inner casing or no stator blade carrier.

For reasons of efficiency, the design of such a steam turbine for so-called "high steam parameters", therefore especially high steam pressures and/or high steam temperatures, can be desirable. However, especially a temperature increase is not indefinitely possible for material engineering reasons. To enable a safe operation of the steam turbine in this case, even at especially high temperatures, a cooling of individual component parts or components, therefore, can be desirable. The component parts are specifically limited in their resistance to temperature. Without efficient cooling, significantly more expensive materials (for example, nickel based alloys) would be necessary in the case of increasing temperatures.

In the hitherto known cooling methods, especially for a steam turbine body in the form of a steam turbine casing or a rotor, a distinction is to be made between an active cooling and a passive cooling. In an active cooling, a cooling is effected by means of a cooling medium which is fed separately to the steam turbine body, i.e. in addition to the working medium. In contrast, a passive cooling takes place purely by means of a suitable guiding or application of the working medium. Up to now, steam turbine bodies were preferably passively cooled.

In this way, for example from DE 34 21 067 C2, it is known to circulate cool, already expanded steam around an inner casing of a steam turbine. However, this has the disadvantage that a temperature difference over the inner casing wall must remain limited since otherwise with too great a temperature difference the inner casing would be too severely thermally deformed. During a circulating of flow around the inner casing, in fact a heat discharge takes place, however, the heat discharge takes place relatively far away from the point of the heat feed. A heat discharge in the direct vicinity of the heat feed has not been put into effect in sufficient measure up to now. A further passive cooling, by means of a suitable design of the expansion of the working medium can be achieved in a so-called diagonal stage. By this, however, only a very limited cooling action for the casing can be achieved.

An active cooling of individual components inside a steam turbine casing is described in U.S. Pat. No. 6,102,654, wherein the cooling is limited to the inflow region of the hot working medium. Some of the cooling medium is added to the working medium. In this case, the cooling is to be achieved by a flow-washing of the components to be cooled.

From WO 97/49901 and WO 97/49900 it is known to selectively charge an individual stator blade ring, for shielding of individual rotor sections, with a medium by means of a separate radial passage in the rotor, which is fed from a central chamber. For this purpose, the medium is added to the working medium via the passage and the stator blade ring is selectively flow-washed. In the center hollow bore of the rotor which: is provided for this, however, increased centrifugal force stresses are to be taken into account, which represents a considerable disadvantage in design and operation.

A steam turbine with a balance piston is disclosed in U.S. Pat. No. 3,614,255, wherein the balance piston is exposed to steam flow which flows from a line which leads into the flow passage downstream of a blade row. A single-flow steam turbine with a balance piston is disclosed in U.S. Pat. No. 4,661,043, wherein the balance piston is cooled. A single-flow steam turbine with a balance piston is disclosed in U.S. Pat. No. 2,796,231, which balance piston is exposed to cooling steam flow via a line which is located in the inner casing.

A possibility for extraction and guiding of a cooling medium from other areas of a steam system, and feed of the cooling medium in the inflow region of the working medium, is described in EP 1 154 123.

To achieve higher efficiencies in current generation with fossil fuels, the requirement exists to use higher steam parameters, i.e. higher pressures and temperatures in a turbine, than were customary up to now. In the case of high temperature steam turbines, with steam as the working medium, temperatures in part well above 500° C., especially above 540° C., are provided. Such steam parameters for high temperature steam turbines are disclosed in detail in the article "New Steam Turbine Concepts for Higher Inlet Parameters and Longer End Blades" by H. G. Neft and G. Franconville in the magazine VGB Power Plant Technology, Nr. 73 (1993), issue 5. The disclosure content of the article is introduced herewith in the description of this application in order to disclose different embodiments of a high temperature steam turbine. Examples of higher steam parameters for high temperature steam turbines are especially referred to in FIG. 13 of the article. In the article which is referred to, a cooling steam feed and transmission of the cooling steam through the first stator blade row is proposed for improving the cooling of a high temperature steam turbine casing. By this, an active cooling is indeed made available. However, this is limited to the main flow region of the working medium and is still worthy of improvement.

All cooling methods which are known for a steam turbine casing up to now, therefore, in so far as they are principally active cooling methods, provide in any event a concentrated flow-washing of a separate turbine section which is to be cooled, and are limited to the inflow region of the working medium, in any event with inclusion of the first stator blade ring. During a loading of conventional steam turbines with higher steam parameters, this can lead to an increased thermal loading which affects the whole turbine, which could be only inadequately reduced by means of a customary cooling of the casing which is described above. Steam turbines which, for achieving higher efficiencies, operate principally with higher steam parameters, require an improved cooling, especially cooling of the casing and/or the rotor, in order to relax a higher thermal loading of the steam turbine in sufficient measure. In this case, there is the problem that during the use of hitherto customary turbine materials, the increasing stress of the steam turbine body as a result of increased steam parameters, for example according to the "Neft" article, can lead to a disadvantageous thermal loading of the steam turbine. Consequently, a production of this steam turbine is hardly possible anymore.

An effective cooling is desirable in a steam turbine component, especially for a steam turbine which is operated in the high temperature range.

SUMMARY OF INVENTION

The invention starts at this point, the object of which invention is a steam turbine and a method for its production, in which the steam turbine itself is especially effectively cooled in the high temperature range.

With regard to the steam turbine, the object is achieved by a steam turbine of the type mentioned at the beginning, with an outer casing and an inner casing, wherein the outer casing and the inner casing have a live steam feed duct, wherein a rotor, which has a thrust balance piston and which comprises a plurality of rotor blades, is installed in a rotatably mounted manner inside the inner casing, and the inner casing has a plurality of stator blades which are arranged in such a way that a flow passage, with a plurality of blade stages which in each case have a row of rotor blades and a row of stator blades, is formed along a flow direction, wherein the inner casing has a connection which is formed as a communicating pipe between the flow passage downstream of a blade stage and a thrust balance piston antechamber between the thrust balance piston of the rotor and the inner casing, wherein the inner casing has a cross-return passage which is formed as a communicating pipe between a seal chamber between the rotor and the inner casing, and an inlet chamber, which is located downstream of a blade stage in the flow passage, and wherein the cross-return passage extends away from the seal chamber basically perpendicularly to the flow direction, basically parallel to the flow direction after a deflection, and basically perpendicularly to the flow direction after a second deflection.

In an advantageous development, the connection comprises a return passage which is formed as a communicating pipe between a chamber between inner casing and outer casing, and the flow passage downstream of a blade stage. Furthermore, in an advantageous development the connection comprises a feed passage which is formed as a communicating pipe between the chamber between inner casing and outer casing, and a thrust balance piston antechamber between the thrust balance piston of the rotor and the inner casing.

The invention is based on the knowledge that flow medium, in this case steam, can be extracted after a certain number of turbine stages, and this expanded and cooled steam can be directed into a thrust balance piston antechamber. The invention starts from the idea that for steam turbines, which are designed for highest steam parameters, it is important to design both the rotor against high temperatures, and also to design casing sections, like the inner casing or the outer casing and their bolted connection, for high temperatures and pressures.

By the return of cooled and expanded steam into the chamber between the inner casing and the outer casing, the outer side of the inner casing, its bolted connection, and the inner side of the outer casing, experience a lower temperature. Other material, and, if applicable, more cost-effective materials, can be used, therefore, for the outer casing and for the inner casing, and also for its bolted connections. It is also conceivable that the outer casing can be constructed thinner. The return passage and the feed passage in this case are formed in such a way that steam always flows from the flow passage into the thrust balance piston antechamber.

In an advantageous development, the thrust balance piston antechamber is located in an axial direction between thrust balance piston and inner casing. Therefore, the steam which flows into the thrust balance piston antechamber on the one hand fulfills the function of a force exertion for thrust compensation, and on the other hand fulfills the function of a cooling of the thrust balance piston which, especially in high pressure turbine sections, is especially thermally loaded.

In an advantageous development, the return passage and the feed passage are formed basically perpendicularly to the flow direction in the inner casing. The chamber between the inner casing and outer casing in this case is formed for connecting the return passage to the feed passage. Production engineering aspects are in the fore for this arrangement. Furthermore, vertical alignment changes of casing axis to turbine axis are avoided since by means of the concentrated forced flow-washing of the chamber between inner and outer casing, an uncontrolled formation of temperature layers on the casings, which are associated with natural convection, are avoided.

A live steam which flows into the steam turbine flows for the most part through the flow passage. A smaller part of the live steam does not flow through the flow passage but through a seal chamber which is located between the rotor and the inner casing. This part of the steam is also referred to as leakage steam and leads to a loss of efficiency of the steam turbine. This leakage steam, which has approximately live steam temperature and live steam pressure, thermally loads the rotor and the inner casing in the seal chamber severely. This hot sealing steam, at high pressure, is directed through the cross-return passage from the seal chamber through the inner casing again into the flow passage downstream of a blade stage, and subsequently expanded.

Therefore, the cross-return passage can be especially simply formed with regard to production engineering, which considerably lowers the capital outlay costs.

In a further advantageous development, an overload inlet, which leads through the outer casing and inner casing, leads into the inflow chamber. During operation of a steam turbine, it is quite customary to temporarily guide additional steam through an overload inlet into the steam turbine in order to achieve greater power as a result of it. By means of the cross-return passage which, just like the overload inlet, leads into the inflow chamber, steam is additionally delivered which altogether leads to an efficiency increase of the steam turbine.

The return passage is advantageously connected to the flow passage downstream of a return blade stage, and the cross-return passage is connected to the flow passage downstream of a cross-return blade stage, wherein the cross-return blade stage is located in the flow direction of the flow passage downstream of the return blade stage.

The return blade stage is especially the fourth blade stage, and the cross-return blade stage is the fifth blade stage. Depending upon the embodiment of the steam turbine, another blade stage is also possible.

The object which relates to the method is achieved by a method for production of a steam turbine with an outer casing and an inner casing, wherein the outer casing and the inner casing have a live steam feed duct, wherein a rotor, which has a thrust balance piston and which comprises a plurality of rotor blades, is installed in a rotatably mounted manner inside the inner casing, and a plurality of stator blades are arranged on the inner casing in such a way that a flow passage, with a plurality of blade stages which in each case have a row of rotor blades and a row of stator blades, is formed along a flow direction, through which flow passages steam flows during operation, wherein steam downstream of a blade stage flows through a connection into a thrust balance piston antechamber, which is located between the thrust balance piston of the rotor and the inner casing.

In an advantageous development, the steam flows downstream of the blade stage through a return passage, which is located in the inner casing, into a chamber between inner casing and outer casing, and from there through a feed passage, which is located in the inner casing, into the thrust balance piston antechamber, which is located between the thrust balance piston of the rotor and the inner casing.

The advantages which are related to the method result in accordance with the aforementioned advantages which are related to the steam turbine.

It is especially advantageous that a thrust compensation is achieved by the steam in the thrust balance piston antechamber.

The live steam temperatures advantageously lie between 550° C. and 600° C., and the temperature of the steam which flows in the return passage lies between 520° C. and 550° C. It is further advantageous that the steam flows into the overload inlet at temperatures between 550° C. and 600° C. It is just as advantageous that the steam flows into the cross-return passage at temperatures between 540° C. and 560° C.

BRIEF DESCRIPTION OF THE DRAWINGS

The invention is described in detail with reference to schematic drawings of exemplary embodiments. In the drawings.

DETAILED DESCRIPTION OF INVENTION

Figure 1:
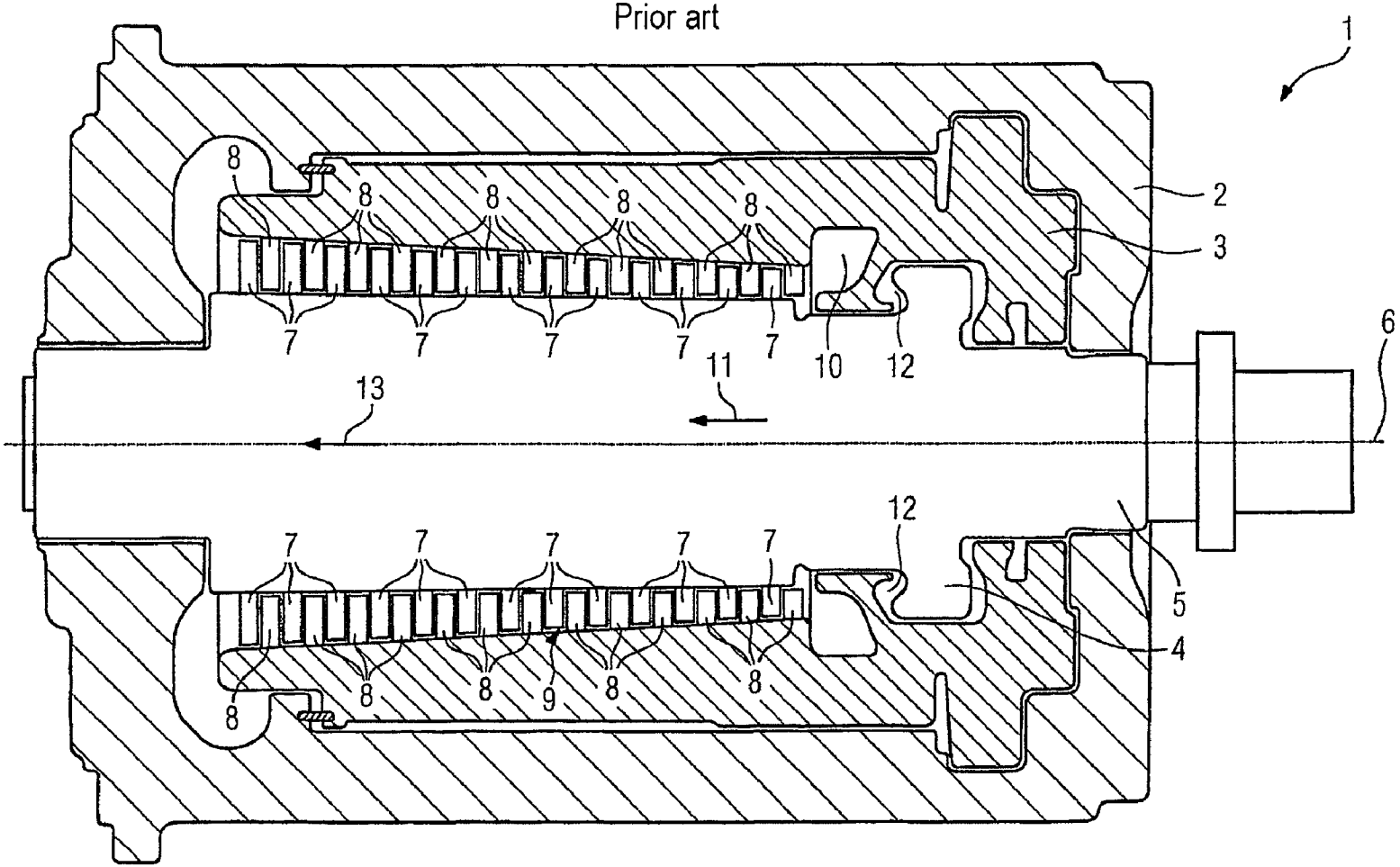
FIG 1 Prior art
FIG. 1 shows a cross section through a steam turbine according to the prior art.

A cross section through a steam turbine 1 according to the prior art is shown in FIG. 1. The steam turbine 1 has an outer casing 2 and an inner casing 3. The inner casing 3 and the outer casing 2 have a live steam feed duct, which is not shown in detail. A rotor 5, which has a thrust balance piston 4, is installed inside the inner casing 3 in a rotatably mounted manner. The rotor is customarily formed rotationally symmetrically around a rotational axis 6. The rotor 5 comprises a plurality of rotor blades 7. The inner casing 3 has a plurality of stator blades 8. A flow passage 9 is formed between the inner casing 3 and the rotor 5. A flow passage 9 comprises a plurality of blade stages which in each case are formed from a row of rotor blades 7 and a row of stator blades 8.

Live steam flows through the live steam feed duct into an inlet opening 10 and from there flows in a flow direction 11 through the flow passage 9 which extends basically parallel to the rotational axis 6. The live steam expands and is cooled down while doing so. During this, thermal energy is converted into rotational energy. The rotor 5 is set in a rotational movement and can drive a generator for the generation of electrical energy.

Depending upon the type of blading of the stator blades 8 and rotor blades 7, a thrust of lesser or greater extent of the rotor 5 develops in the flow direction 11. A thrust balance piston 4 is customarily formed in such a way that a thrust balance piston antechamber 12 is formed. A counterforce, which counteracts a thrust force 13, develops by means of feed of steam into the thrust balance piston antechamber 12.

Figure 2:
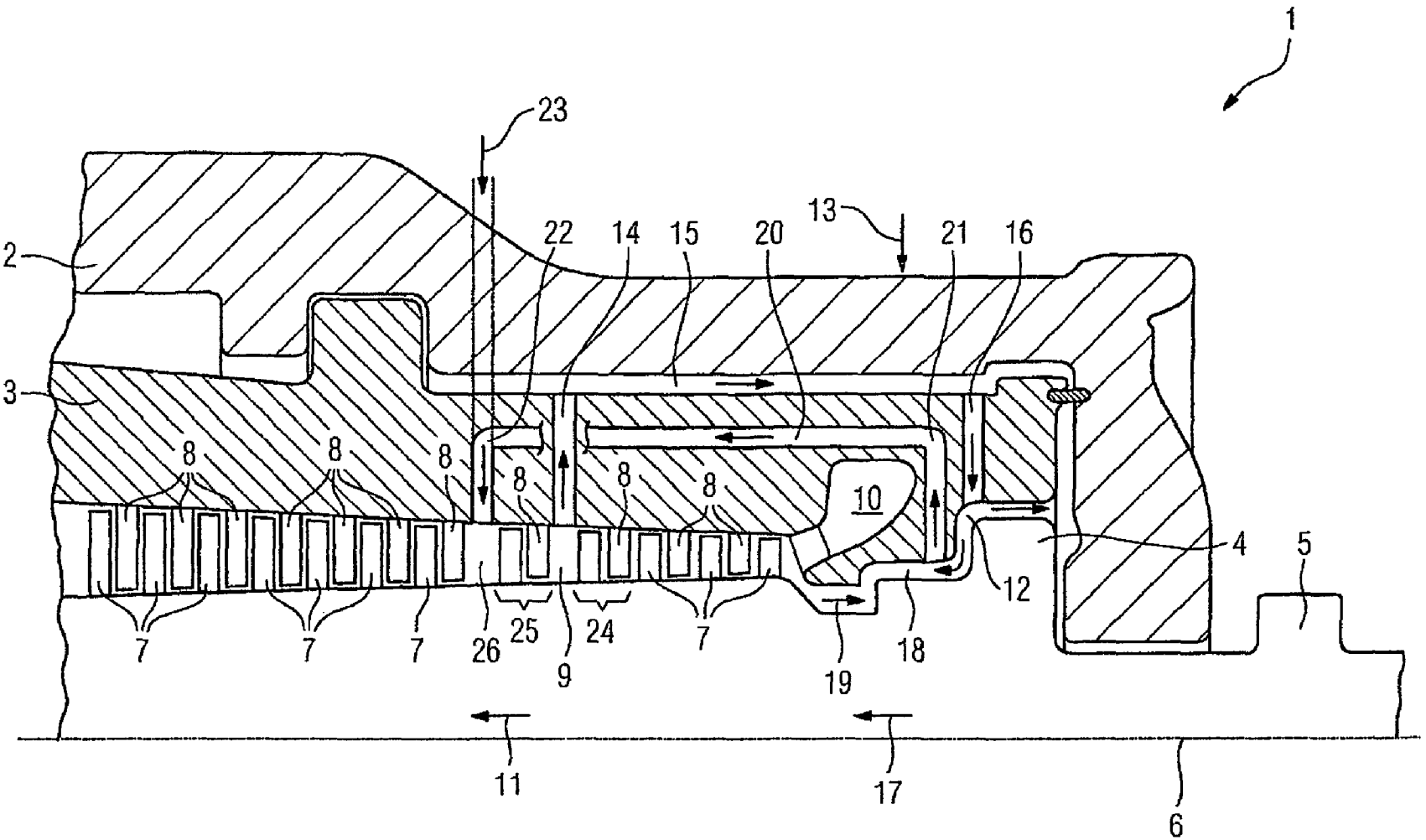
FIG. 2 shows a partial section through a steam turbine with a first arrangement.

A partial section of a steam turbine 1 is seen in FIG. 2. In operation, steam flows through the live steam feed duct, which is not shown in detail, into the inlet chamber 10. The live steam feed is shown symbolically by the arrow 13. In this case, the live steam customarily has temperature values of up to 600° C. and a pressure of up to 258 bar. The live steam flows in the flow direction 11 through the flow passage 9. Downstream of a blade stage, the steam flows through a connection 14, 15, 16 which is formed as a communicating pipe between the flow passage 9 and a thrust balance piston 4 of the rotor 5 and the inner casing 3.

The steam flows especially through a return passage 14, which is formed as a communicating pipe between a chamber 15 between inner casing 3 and outer casing 2 and the flow passage 9 downstream of a blade stage, into the chamber 15 between inner casing 3 and outer casing 2. The steam which is present in the chamber 15 between inner casing 3 and outer casing 2 now has a temperature of about 532° C. and a pressure of about 176 bar. The steam flows into the thrust balance piston antechamber 12 through a feed passage 16, which is formed as a communicating pipe between the chamber 15 between inner casing 3 and outer casing 2 and the thrust balance piston antechamber 12 between the thrust balance piston 4 of the rotor 5 and the inner casing 3.

In the exemplary embodiment which is shown in FIG. 2, the thrust balance piston antechamber 12 is located in an axial direction 17 between thrust balance piston 4 and inner casing 3. A live steam which flows into the chamber 10 flows for the most part in the flow direction 11 into the flow passage 9. A smaller part flows as leakage steam into a seal chamber 18. In this case, the leakage steam flows basically in an opposite direction 19. The leakage steam flows into the flow passage 9 through a cross-return passage 20, which is formed as a communicating pipe between the seal chamber 18 between the rotor 5 and the casing 3 and an inflow chamber 21 which is located downstream of a blade stage in the flow passage 9. In this case, the cross-return passage 20 extends away from the seal chamber 18 basically perpendicularly to the flow direction 11, basically parallel to the flow direction 11 after a deflection 21, and basically perpendicularly to the flow direction 11 after a second deflection 22.

In an alternative embodiment, the inner casing and outer casing can be formed with an overload inlet which is not shown in detail. External steam flows into the overload inlet, which flow is symbolized by the arrow 23.

In a preferred exemplary embodiment, the return passage 14 is connected to the flow passage 9 downstream of a return blade stage 24, and the cross-return passage 20 is connected to the flow passage 9 downstream of a cross-return blade stage 25. In this case, the cross-return blade stage 25 is located in the flow direction 11 of the flow passage 9 downstream of the return blade stage 24.

In an especially preferred exemplary embodiment, the return blade stage 24 is the fourth blade stage and the cross-return blade stage is the fifth blade stage.

The invention claimed is:

1. A steam turbine, comprising:

a rotor arranged along a rotational axis of the turbine having a thrust balance piston and a plurality of rotor blades;

an inner casing enclosing a live steam feed duct;

a plurality of stator blades arranged in the inner casing such that a flow passage having a plurality of blade stages is formed along a flow direction of the turbine where each blade stage is comprised of a row of rotor and stator blades;

a communication passage arranged between the inner casing flow passage downstream of one of the plurality of blade stages and a thrust balance piston antechamber, the thrust balance piston antechamber is disposed between the thrust balance piston of the rotor and the inner casing;

a cross-return passage completely arranged in the inner casing between a seal chamber of the rotor and the inner casing and an inflow chamber located downstream of one of the plurality of blade stages in the flow passage; and an outer casing having a live steam duct that rotably supports the rotor and surrounds the inner casing.

2. The steam turbine as claimed in claim 1, wherein the communication passage comprises:

a return passage arranged between a chamber located between the inner and outer casing and the flow passage downstream of one of the plurality of blade stages, and a feed passage arranged between the chamber located between the inner and outer casing and the thrust balance piston antechamber located between the thrust balance piston of the rotor and the inner casing.

3. The steam turbine as claimed in claim 2, wherein the thrust balance piston antechamber is arranged in an axial direction between the thrust balance piston and the inner casing.

4. The steam turbine as claimed in claim 3, wherein the return passage and the feed passage are arranged essentially perpendicular to the flow direction in the inner casing, and the chamber is formed between the inner and outer casings for connecting the return passage to the feed passage.

5. The steam turbine as claimed in claim 4, wherein the cross-return passage extends away from the seal chamber essentially perpendicular to the flow direction, and then essentially parallel to the flow direction after a direction change, and essentially perpendicular to the flow direction after a second direction change.

6. The steam turbine as claimed in claim 5, wherein an overload inlet leads through the outer and the inner casings and into the inflow chamber.

7. The steam turbine as claimed in claim 6, wherein the return passage is connected to the flow passage downstream of a return blade stage, and the cross-return passage is connected to the flow passage downstream of a cross-return blade stage, wherein the cross-return blade stage in the flow direction of the flow passage is located downstream of the return blade stage.

8. The steam turbine as claimed in claim 7, wherein the return blade stage is the fourth blade stage of the plurality of blade stages with respect to the direction of flow, and the cross-return blade stage is the fifth blade stage of the plurality of blade stages with respect to the direction of flow.

9. A method for operating a steam turbine with an outer casing and an inner casing, comprising:

providing the inner casing enclosing a live steam feed duct;

rotably mounting a rotor within the inner casing where the rotor has a thrust balance piston and a plurality of rotor blades attached to the rotor; and arranging a plurality of stator blades on the inner casing such that a flow passage having a plurality of blade stages is formed along a flow direction of the turbine where each blade stage is comprised of a row of rotor and stator blades through which flow passage steam flows during operation, wherein steam downstream of one of the plurality of blade stages flows through a connection passage into a thrust balance piston antechamber located between the thrust balance piston of the rotor and the inner casing, and steam present in a seal chamber arranged between the rotor and the inner casing flows through a cross-return passage completely arranged in the inner casing into an inflow chamber located downstream of one of the plurality of blade stages.

10. The method as claimed in claim 9, wherein the steam downstream of one of the plurality of blade stages flows through a return passage located in the inner casing, into a chamber between the inner and outer casing, and then flows through a feed passage located in the inner casing into the thrust balance piston antechamber located between the thrust balance piston of the rotor and the inner casing.

11. The method as claimed in claim 10, wherein the steam in the thrust balance piston antechamber balances the thrust effects of the operative steam turbine.

12. The method as claimed in claim 9, wherein an overload steam flows through an overload inlet into the inflow chamber.

13. The method as claimed in claim 12, wherein a steam in the live steam feed duct is at a temperature between 550° C. and 600° C.

14. The method as claimed in claim 13, wherein the steam in the return passage is at a temperature between 520° C. and 550° C.

15. The method as claimed in claim 14, wherein the overload steam in the overload inlet is at a temperature between 550° C. and 600° C.

16. The method as claimed in claim 15, wherein the steam in the cross-return passage is at a temperature between 540° C. and 560° C.

* * * * *